US010535364B1

(12) United States Patent
Zhong et al.

(10) Patent No.: US 10,535,364 B1
(45) Date of Patent: Jan. 14, 2020

(54) VOICE ACTIVITY DETECTION USING AIR CONDUCTION AND BONE CONDUCTION MICROPHONES

(71) Applicant: AMAZON TECHNOLOGIES, INC., Seattle, WA (US)

(72) Inventors: Xuan Zhong, Mountain View, CA (US); Bozhao Tan, Sunnyvale, CA (US); Jianchun Dong, Palo Alto, CA (US); Chia-Jean Wang, Palo Alto, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 15/260,220

(22) Filed: Sep. 8, 2016

(51) Int. Cl.

| | |
|---|---|
| ***G10L 25/78*** | (2013.01) |
| ***G10L 25/93*** | (2013.01) |
| ***G10L 25/84*** | (2013.01) |
| ***G10L 25/09*** | (2013.01) |
| *G10L 21/0216* | (2013.01) |

(52) U.S. Cl.
CPC ..... *G10L 25/84* (2013.01); *G10L 25/09* (2013.01); *G10L 25/78* (2013.01); *G10L 25/93* (2013.01); *G10L 2021/02165* (2013.01); *G10L 2025/783* (2013.01)

(58) Field of Classification Search
CPC ..... G10L 25/78; G10L 25/93
See application file for complete search history.

(56) References Cited

U.S. PATENT DOCUMENTS

| | | | | |
|---|---|---|---|---|
| 6,148,282 | A * | 11/2000 | Paksoy | G10L 19/18 704/208 |
| 9,135,915 | B1 * | 9/2015 | Johnson | G10L 15/26 |
| 9,779,758 | B2 * | 10/2017 | Johnson | G10L 21/16 |
| 2005/0114124 | A1 * | 5/2005 | Liu | G10L 21/0208 704/228 |
| 2006/0178880 | A1 * | 8/2006 | Zhang | G10L 21/0208 704/233 |
| 2006/0293887 | A1 * | 12/2006 | Zhang | G10L 21/0208 704/233 |
| 2008/0181433 | A1 * | 7/2008 | Thomas | G10K 11/16 381/94.5 |
| 2008/0317261 | A1 * | 12/2008 | Yoshida | H04R 3/04 381/94.1 |

(Continued)

OTHER PUBLICATIONS

"Signal Energy and Power". Retrieved from Internet: <https://matel.p. lodz.pl/wee/i12zet/Signal%20energy%20and%20power.pdf>.

(Continued)

*Primary Examiner* — Bryan S Blankenagel
(74) *Attorney, Agent, or Firm* — Lindauer Law, PLLC

(57) ABSTRACT

A head-mounted wearable device incorporates a transducer that operates as a bone conduction (BC) microphone. Vibrations from a user's speech are transferred through the head of the user to the BC microphone. An air conduction (AC) microphone detects sound transferred via air. Signals from the BC microphone and the AC microphone are compared to determine if a common signal is present in both. For example, both signals may have a cross-correlation that exceeds a threshold value. Based on the comparison, voice activity data is generated that indicates the user wearing the device is speaking.

21 Claims, 7 Drawing Sheets

(56) References Cited

U.S. PATENT DOCUMENTS

2009/0296965 A1* 12/2009 Kojima ..... H04R 25/407 381/312
2010/0046770 A1* 2/2010 Chan ..... H04R 3/005 381/92
2011/0208520 A1* 8/2011 Lee ..... G10L 25/78 704/233
2011/0288860 A1* 11/2011 Schevciw ..... G10L 25/78 704/233
2013/0006404 A1* 1/2013 Pitkanen ..... G06F 3/165 700/94
2013/0225915 A1* 8/2013 Redfield ..... A61N 5/0618 600/28
2014/0029762 A1* 1/2014 Xie ..... H04R 5/027 381/94.1
2014/0050326 A1* 2/2014 Vesa ..... H04R 5/027 381/26
2014/0071156 A1* 3/2014 Lee ..... G06T 7/0002 345/611
2014/0211951 A1* 7/2014 Paranjpe ..... H04R 3/005 381/26
2014/0363020 A1* 12/2014 Endo ..... H04R 1/08 381/98
2015/0131814 A1* 5/2015 Usher ..... G06F 3/017 381/123
2015/0133716 A1* 5/2015 Suhami ..... A61N 2/002 600/9
2015/0179189 A1* 6/2015 Dadu ..... G10L 15/20 704/275
2016/0171965 A1* 6/2016 Arai ..... H04R 29/00 381/56
2017/0116995 A1* 4/2017 Ady ..... G10L 17/24
2017/0163778 A1* 6/2017 Noma ..... H04M 1/00
2017/0169828 A1* 6/2017 Sachdev ..... G10L 17/04
2017/0178668 A1* 6/2017 Kar ..... G10L 25/78
2017/0229137 A1* 8/2017 Osako ..... G10L 21/0264
2017/0256270 A1* 9/2017 Singaraju ..... G10L 25/84

OTHER PUBLICATIONS

Bachu, et al., "Separation of Voiced and Unvoiced using Zero crossing rate and Energy of the Speech Signal", Electrical Engineering Department. School of Engineering, University of Bridgeport. Retrieved from Internet: <https://www.asee.org/documents/zones/zone1/2008/student/ASEE12008_0044_paper.pdf>.

Cassisi, et al., "Similarity Measures and Dimensionality Reduction Techniques for Time Series Data Mining", InTech. 2012. Retrieved from Internet: <http://cdn.intechopen.com/pdfs-wm/39030.pdf>.

Lokhande, et al., "Voice Activity Detection Algorithm for Speech Recognition Applications", International Conference in Computational Intelligence (ICCIA) 2011. Retrieved from Internet: <http://research.ijcaonline.org/iccia/number6/iccia1046.pdf>.

Shete, et al., "Zero crossing rate and Energy of the Speech Signal of Devanagari Script", IOSR Journal of VLSI and Signal Processing. vol. 4, Issue 1, Ver. 1 (Jan. 2014). pp. 01-05. Retrieved from Internet: <http://iosrjournals.org/iosr-ivlsi/papers/vol4-issue1/Version-1/A04110105.pdf>.

* cited by examiner

VOICE ACTIVITY DETECTION USING AIR CONDUCTION AND BONE CONDUCTION MICROPHONES

BACKGROUND

Wearable devices provide many benefits to users, allowing easier and more convenient access to information and services.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
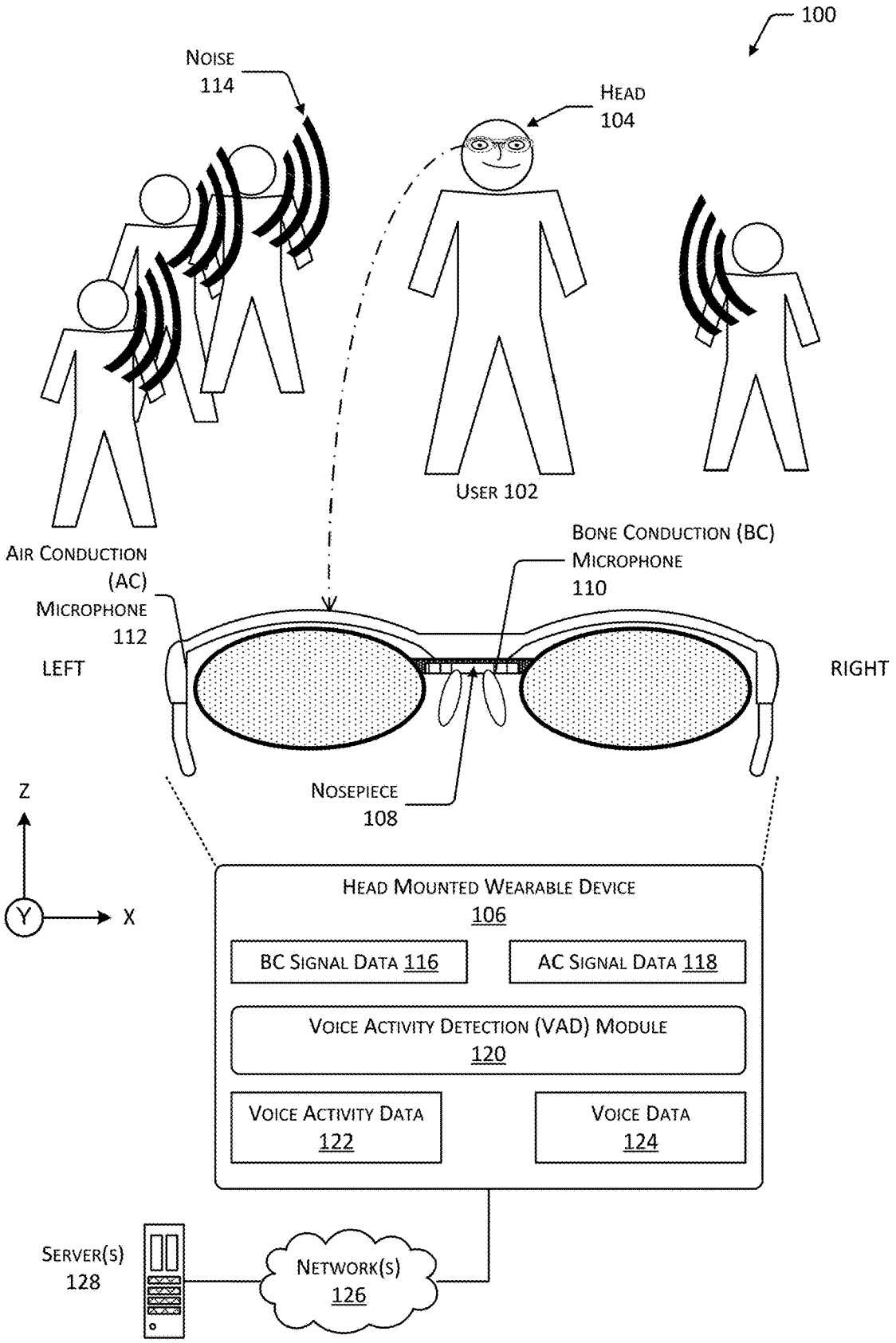
FIG. 1 depicts a system including a head-mounted wearable device including an air conduction (AC) microphone and a bone conduction (BC) microphone that are used to determine if a wearer is speaking, according to some implementations.

While implementations are described herein by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean "including, but not limited to".

DETAILED DESCRIPTION

Wearable devices provide many benefits to users, allowing easier and more convenient access to information and services. For example, a head-mounted wearable device having a form factor similar to eyeglasses may provide a ubiquitous and easily worn device that facilitates access to information.

Traditional head-mounted wearable devices (HMWDs) have utilized air conduction microphones to obtain information from the user. For example, an air conduction microphone detects sounds in the air as expelled by the wearer during speech. However, the air conduction microphone may also detect other sounds from other sources, such as someone else who is speaking nearby, public address systems, and so forth. These other sounds may interfere with the sounds produced by the wearer.

Described in this disclosure are techniques to use data from both a bone conduction (BC) microphone and an air conduction (AC) microphone to generate voice activity data that indicates if the user wearing the HMWD is speaking.

The BC microphone, or elements associated with it, may be arranged to be in contact with the skin above a bony or cartilaginous structure of a user. For example, where the wearable device is in the form of eyeglasses, nose pads of a nosepiece may be mechanically coupled to a BC microphone such that vibrations of the nasal bone, glabella, or other structures of the user upon which the nose pads may rest are transmitted to the BC microphone. The BC microphone may comprise an accelerometer. The BC microphone produces BC signal data representative of a signal detected by the BC microphone.

The AC microphone may comprise a diaphragm or other elements that move in response to a displacement of air by sound waves. The AC microphone produces AC signal data representative of a signal detected by the AC microphone.

During operation, the AC microphone may detect the speech of the wearer as well as noise from the surrounding environment. As a result, based on the AC signal data alone, speech from someone speaking nearby may be detected and lead to an incorrect determination that the user is speaking. In comparison, the sounds detected by the BC microphone are predominately those produced by the user's speech. Outside sounds are poorly coupled to the body of the user, and thus are poorly propagated through the user's body to the BC microphone. As a result, the signal data produced by the BC microphone is primarily that of sounds generated by the user.

The BC microphone may produce output that sounds less appealing to the human ear than the AC microphone. For example, compared to the BC microphone, the AC microphone may result in audio which sounds clearer and more intelligible to a listener. This may be due to operational characteristics of the BC microphone, nature of the propagation of the sound waves through the user, and so forth.

By using information about the output from both the AC microphone and the BC microphone, the techniques described herein enable generation of the voice activity data. In one implementation, the BC signal data and the AC signal data are processed to determine presence of speech. If both signals show the presence of speech, voice activity data indicative of speech may be generated. In another implementation, one or more of the BC signal data or the AC signal data are processed to determine presence of speech. The BC signal data and the AC signal data are processed to determine comparison data that is indicative of the extent of similarity between the two. For example, a cross-correlation algorithm may be used to generate comparison data that is indicative of the correlation between the BC signal data and the AC signal data. If the comparison data indicates a similarity that exceeds a threshold value, voice activity data is generated that indicates the user wearing the BC microphone is speaking.

The voice activity data may be used to trigger other activities by the device or a system in communication with the device. For example, after determining that the user is speaking, the AC signal data may be processed by a speech recognition module, used for a voice over internet protocol (VOIP) call, and so forth.

By utilizing the techniques described herein, the user of a wearable computing device such as a head-mounted wearable device (HMWD) is able to provide verbal input in environments with ambient noise. The ambient noise is recognized as being distinct from the voice of the wearer, and thus may be ignored. For example, in a crowded room, a user wearing the head-mounted computing device is able to provide verbal commands to their particular device, while the speech from other users nearby does not produce a response by the particular device. As a result, functionality of the wearable device is improved, user experience is improved, and so forth.

Illustrative System

FIG. 1 depicts a system 100 in which a user 102 is wearing on their head 104 a head mounted wearable device (HMWD) 106 in a general form factor of eyeglasses. The HMWD 106 may incorporate hinges to allow the temples of the eyeglasses to fold. The eyeglasses may include a nosepiece 108 that aids in supporting a front frame of the eyeglasses by resting on or otherwise being supported by the bridge of the nose of the user 102. A bone conduction (BC) microphone 110 may be proximate to or coupled to the nosepiece 108.

The BC microphone 110 may comprise a device that is able to generate output indicative of audio frequency vibrations having frequencies occurring between about 10 hertz and at least 22 kilohertz (kHz).

In some implementations, the BC microphone 110 may be sensitive to a particular band of audio frequencies within this range. For example, the BC microphone 110 may be sensitive from 100 Hz to 4 kHz. In one implementation, the BC microphone 110 may comprise an accelerometer. For example, the BC microphone 110 may comprise a piezoceramic accelerometer in the BU product family as produced by Knowles Electronics LLC of Itasca, Ill. Continuing the example, the Knowles BU-23842 vibration transducer provides an analog output signal that may processed as would the analog output from a conventional air conduction microphone. The accelerometer may utilize piezoelectric elements, microelectromechanical elements, optical elements, capacitive elements, and so forth.

In another implementation, the BC microphone 110 comprises a piezoelectric transducer that uses piezoelectric material to generate an electronic signal responsive to the deflection of the piezoelectric material responsive to vibrations. For example, the BC microphone 110 may comprise a piezoelectric bar device.

In yet another implementation, the BC microphone 110 may comprise electromagnetic coils, an armature, and so forth. For example, the BC microphone 110 may comprise a variation on the balanced electromagnetic separation transducer (BEST) as proposed by Bo E. V. Hakansson of the Chalmers University of Technology in Sweden that is configured to detect vibration.

The BC microphone 110 may detect vibrations using other mechanisms. For example, a force sensitive resistor may be used to detect the vibration. In another example, the BC microphone 110 may measure changes in electrical capacitance to detect the vibrations. In yet another example, the BC microphone 110 may comprise a microelectromechanical system (MEMS) device.

The BC microphone 110 may include or be connected to circuitry that generates or amplifies the output from the BC microphone 110. For example, the accelerometer may produce an analog signal as the output. This analog signal may be provided to an analog to digital converter (ADC). The ADC measures an analog waveform and generates an output of digital data. A processor may subsequently process the digital data.

The BC microphone 110, or elements associated with it such as the nosepiece 108, may be arranged to be in contact with the skin above a bony or cartilaginous structure. For example, where the HMWD 106 is in the form of eyeglasses, nose pads of a nosepiece may be mechanically coupled to the BC microphone 110 such that vibrations of the nasal bone, glabella, or other structures upon which the nose pads may rest are transmitted to the BC microphone 110. In other implementations, the BC microphone 110 may be located elsewhere with respect to the HMWD 106, or worn elsewhere by the user 102. For example, the BC microphone 110 may be incorporated into the temple of the HMWD 106, into a hat or headband, and so forth.

The HMWD 106 also includes an air conduction (AC) microphone 112. The AC microphone 112 may comprise a diaphragm or other elements that move in response to the displacement of a medium that conducts sound waves. For example, the AC microphone 112 may comprise a microelectromechanical system (MEMS) device or other transducer that detects sound waves propagated as compressive changes in the air. Continuing the example, the AC microphone 112 may comprise a SPH0641LM4H-1 microphone produced by Knowles Electronics LLC of Itasca, Ill., USA. In one implementation depicted here, the AC microphone 112 is located proximate to a left hinge of the HMWD 106.

During use of the HMWD 106, noise 114 may be present. For example, the noise 114 may comprise the speech from other users, mechanical sounds, weather sounds, and so forth. Presence of this noise 114 may make it difficult for the HMWD 106 or another device receiving information from the HMWD 106 to determine if the user 102 who is wearing the HMWD 106 on their head 104 is speaking. The user 102, when speaking, may produce voiced speech or unvoiced speech. The systems and techniques described herein may be used with one or more of voiced speech or unvoiced speech. Voiced speech includes phonemes which are produced by the vocal cords and the vocal tract. Unvoiced speech includes sounds that do not use the vocal cords. For example, the English vowel sound of "o" would be voiced speech while the sound of "k" is unvoiced.

Output from the BC microphone 110 is used to produce BC signal data 116 that is representative of a signal detected by the BC microphone 110. For example, the BC signal data 116 may comprise samples of data arranged into frames, with each sample comprising a digitized value that represents a portion of an analog waveform produced by a sensor at a particular time. For example, the BC signal data 116 may comprise a frame of pulse-code modulation (PCM) data or pulse-density modulation (PDM) that encodes an analog signal from an accelerometer that is used as the BC microphone 110. In one implementation, the BC microphone 110 may be an analog device that provides an analog output to an analog to digital (ADC) converter. The ADC may then provide a digital PDM output that is representative of the analog output. The BC signal data 116 may be further processed, such as converting from PDM to PCM, signal filtering may be applied, and so forth.

Output from the AC microphone 112 is used to produce AC signal data 118 that is representative of a signal detected by the AC microphone 112. For example, the AC signal data 118 may comprise samples of data arranged into frames, with each sample comprising a digitized value that represents a portion of an analog waveform produced by the AC microphone 112 at a particular time. For example, the AC signal data 118 may comprise a frame of PCM or PDM data.

A voice activity detection (VAD) module 120 is configured to process the BC signal data 116 and the AC signal data 118 to generate voice activity data 122. The processing may include determining the presence of speech in both of the signal data, determining a correlation between the two signals exceeds threshold value, and so forth. Details of the operation of the VAD module 120 are described below in more detail with regard to FIGS. 2-5.

The voice activity data 122 may comprise information indicative of whether the user 102 wearing the HMWD 106 is speaking at a particular time. For example, voice activity data 122 may include a single bit binary value in which that a "0" represents no speech by the user 102 and a "1" indicates that the user 102 is speaking. In some implementations, the voice activity data 122 may include a timestamp. For example, the timestamp may be indicative of the time for which the determination of the voice activity data 122 is deemed to be relevant, such as the time of data acquisition, time of processing, and so forth.

One or more of the BC signal data 116 or the AC signal data 118 are processed to determine presence of speech. The BC signal data 116 and the AC signal data 118 are processed to determine comparison data that is indicative of the extent of similarity between the two. For example, a cross-correlation algorithm may be used to generate comparison data that is indicative of the correlation between the BC signal data 116 and the AC signal data 118. If the comparison data indicates a similarity that exceeds a threshold value, voice activity data 122 that indicates the user who wearing the BC microphone is speaking is generated.

The VAD module 120 may utilize one or more of analog circuitry, digital circuitry, mixed-signal processing circuitry, digital signal processing, field programmable gate arrays (FPGAs), and so forth.

The HMWD 106 may process one or more of the BC signal data 116 or the AC signal data 118 to produce voice data 124. For example, the voice data 124 may comprise the AC signal data 118 that is then processed to reduce or eliminate the noise 114. In another example, the voice data 124 may comprise a composite of the BC signal data 116 and AC signal data 118. The voice data 124 may be subsequently used for issuing commands to a processor of the HMWD 106, communication with an external person or device, and so forth.

The HMWD 106 may exchange voice data 124 using one or more networks 126 with one or more servers 128. The servers 128 may support one or more services. These services may be automated, manual, or combination of automated and manual processes. In some implementations, the HMWD 106 may communicate with another mobile device. For example, the HMWD 106 may use a personal area network (PAN) such as Bluetooth® to communicate with a smartphone.

While HMWD 106 is described in the form factor of eyeglasses, the HMWD 106 may be implemented in other form factors. For example, the HMWD 106 may comprise a device that is worn behind an ear of the user 106, on a headband, as part of a necklace, and so forth. In some implementations, the HMWD 106 may be deployed as a system, comprising a BC microphone 110 that is in communication with another device. For example, the BC microphone 110 may be worn behind the ear while the AC microphone 112 is worn as a necklace. Continuing the example, the BC microphone 110 and the AC microphone 112 may be in wireless communication with one another, or another device. In another example, the BC microphone 110 may be worn as a necklace, or integrated into clothing such that it detects vibrations of the neck, torso, or head 104 of the user 102.

The structures depicted in this and the following figures are not necessarily according to scale. Furthermore, the proportionality of one component to another may change with different implementations. In some illustrations, the scale of a proportionate size of one structure may be exaggerated with respect to another to facilitate illustration, and not necessarily as a limitation.

Figure 2:
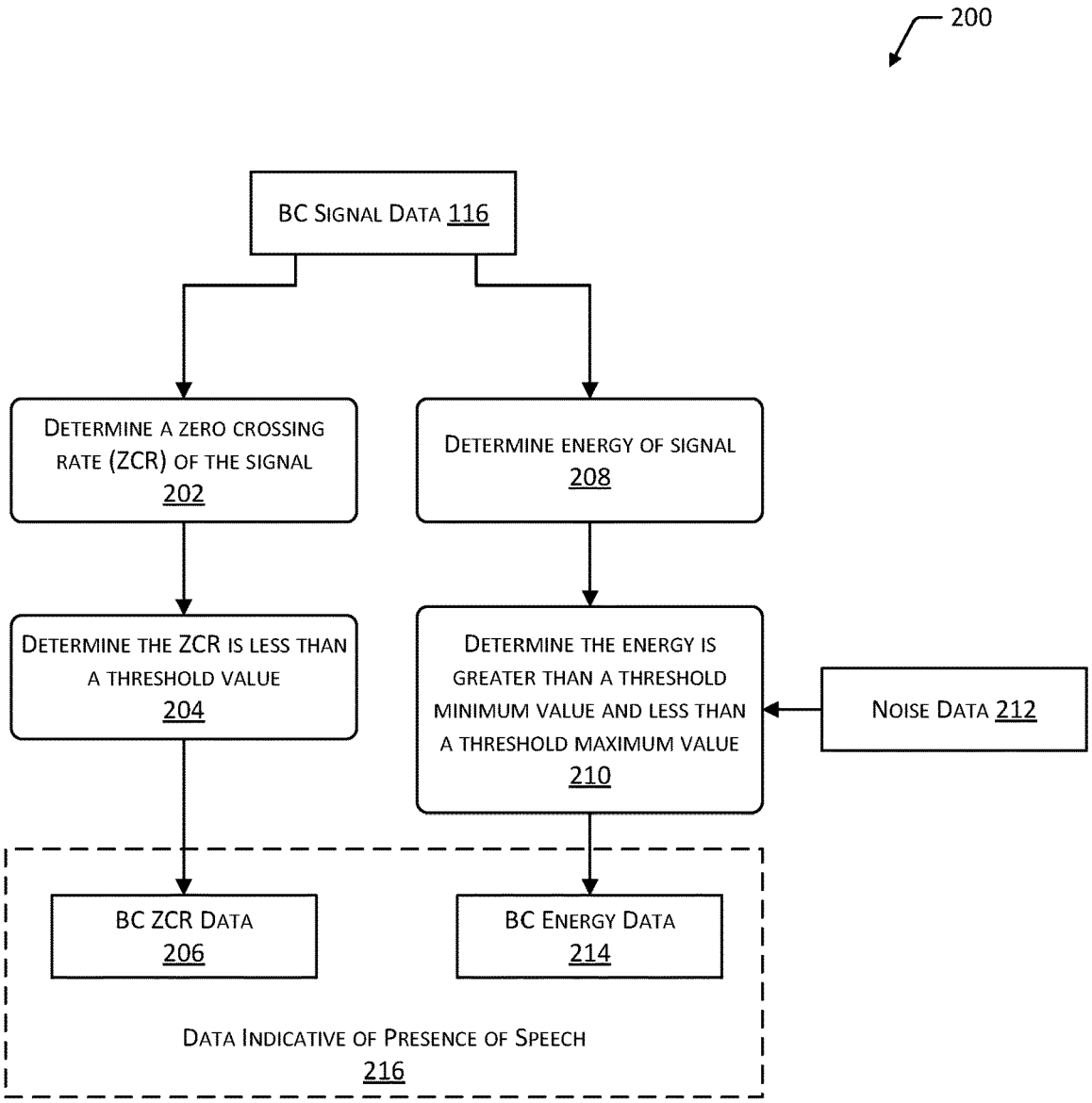
FIG. 2 depicts a flow diagram of a process for determining presence of speech in a signal from a BC microphone, according to some implementations.

FIG. 2 depicts a flow diagram 200 of a process for determining presence of speech in a signal from a BC microphone 110, according to some implementations. The process may be performed at least in part by the HMWD 106.

At 202, a zero crossing rate (ZCR) of at least a portion of the BC signal data 116 is determined. For example, the BC signal data 116 may comprise a single frame of PCM or PDM data that includes a plurality of samples, each sample representative of an analog value at the different times. In other implementations, other digital encoding schemes may be utilized. The PCM or PDM data may thus be representative of an analog waveform that is indicative of motion detected by the BC microphone 110 resulting from vibration of the head 104 of the user 102. As described above, the BC microphone 110 may comprise an accelerometer that produces analog data indicative of motion along one or more axes. As also described above, the AC microphone 112 may comprise an electret element that changes capacitance in response to vibrations of the air. These changes in capacitance result in a time varying analog change in current. The ZCR provides an indication as to how often the waveform transitions from a positive to a negative value. The ZCR may be expressed as a number of times that a mathematical sign (such as positive or negative) of the signal undergoes a change from one to the other. For example, the ZCR may be calculated by dividing a count of transitions from a negative sample value to a positive sample value by a count of sample values under consideration, such as in a single frame of PCM or PDM data. The ZCR may be expressed in terms of units of time (such as number of crossings per second), may be expressed per frame (such as number of crossings per frame), and so forth. In some implementations, the ZCR may be expressed as a quantity of "positive-going" or "negative-going", instead of all crossings.

In some implementations, the BC signal data 116 may be expressed as a value that does not include sign information. In these implementations, the ZCR may be described based on the transition of the value of the signal going above or below a threshold value. For example, the BC signal data 116 may be expressed as a 16 bit unsigned value capable of expressing 65,535 discrete values. When representing an analog waveform that experiences positive and negative changes to voltage, the zero voltage may correspond to a value at a midpoint within that range. Continuing the example, the zero voltage may be represented by a value of 37,767. As a result, digital samples of the analog waveform within the frame may be deemed to be indicative of a negative sign when they have a value less than 37,767 or may be deemed to be indicative of a positive sign when they have a value greater than or equal to 37,767.

Several different techniques may be used to calculate the ZCR. For example, for a frame comprising a given number of samples, the total number of positive zero crossings in which consecutive samples transition from negative to positive may be counted. The total number of positive zero crossings may then be divided by the number of samples to determine the ZCR for that frame.

At 204, the ZCR is determined to be less than a threshold value and BC ZCR data 206 is output. Human speech typically exhibits a relatively low ZCR rate compared to non-speech sounds. Assessment of the ZCR of the BC signal data 116 provides some indication as to whether speech is present in the signal. In one implementation, the threshold value may comprise a moving average of ZCRs from successive frames.

In one implementation, the BC ZCR data 206 may comprise a single bit binary value or flag in which a "1" indicates the BC signal data 116 has a ZCR that is less than a threshold value, while a "0" indicates the BC signal data 116 has a ZCR that is greater than or equal to the threshold value. In other implementations, the BC ZCR data 206 may include the flag, information indicative of the ZCR, and so forth.

The BC signal data 116 may be analyzed in other ways to determine information indicative of the presence of speech. For example, successive ZCRs may be determined for a series of frames. If the ZCR from one frame to the next frame changes beyond a threshold amount, the BC ZCR data 206 may be generated that is indicative of speech in the BC signal data 116.

At 208, a value indicative of the energy of at least a portion of a signal represented by the BC signal data 116 is determined. For the purposes of signal processing and assessment as described herein, the energy of a signal and the power of a signal are not necessarily actual measures of physical energy and power such as involved in moving the BC microphone 110. However, there may be a relationship between the physical energy in the system and the energy of the signal as calculated.

The energy of a signal may be calculated in several ways. For example, the energy of the signal may be determined as the sum of the area under a curve that the waveform describes. In another example, the energy of the signal may be a sum of the square of values for each sample divided by the number of samples per frame. This results in an average energy of the signal per sample. The energy may be indicative of an average energy of the signal for an entire frame, a moving average across several frames of BC signal data 116, and so forth. The energy may be determined for a particular frequency band, group of frequency bands, and so forth.

In one implementation, other characteristics of the signal may be determined instead of the energy. For example, an absolute value may be determined for each sample value in a frame. These absolute values for the entire frame may be summed, and the sum divided by the number of samples in the frame to generate an average value. This average value may be used instead of or in addition to the energy. In another implementation, a peak sample value may be determined for the samples in a frame. The peak value may be used instead of or in addition to the energy.

At 210, the value indicative of the energy is compared to one or more threshold values and BC energy data 214 is generated. In one implementation, noise data 212 may be utilized to determine the one or more threshold values. The noise data 212 is based on the ambient noise as detected by the AC microphone 112 when the voice activity data 122 indicates that the user 102 was not speaking. In other implementations, the noise data 212 may be determined while the user 102 is speaking. The noise data 212 may indicate a maximum detected noise energy, a minimum detected noise energy, an average detected noise energy, and so forth. Assessment of the energy of the BC signal data 116 provides some indication as to whether speech is present in the signal.

The assessment of the energy of the BC signal data 116 may involve comparison to a threshold minimum value and a threshold maximum value that define a range within which the energy of speech is expected to fall. For example, the threshold minimum value may specify a quantity of energy that is deemed to be low to be representative speech. Continuing the example, the threshold maximum value may specify a quantity of energy beyond which speech is not expected to exhibit.

The noise data 212 may be used to specify one or more of the threshold minimum value or the threshold maximum value. For example, the threshold maximum value may be fixed at a predetermined value while the threshold minimum value may be increased or decreased based on changes to the ambient noise represented by the noise data 212. In another example, the threshold maximum value may be based at least in part on the maximum energy. By dynamically adjusting, the system may be better able to determine the voice activity data 122 under varying conditions such as when the HMWD 106 moves from a quiet room to a busy convention center floor. In some implementations, one or more of the threshold minimum value or the threshold maximum value may be adjusted to account for the Lombard effect in which a person speaking in a noisy environment involuntarily speaks more loudly.

At 210, BC energy data 214 is generated. The BC energy data 214 may be generated by determining the energy is greater than a threshold minimum value and less than a threshold maximum value. In one implementation, the BC energy data 214 may comprise a single bit binary value or flag in which a "1" indicates the portion of the BC signal data 116 assessed has an energy value that is within the threshold range, while a "0" indicates the portion of the BC signal data 116 assessed has an energy value that is outside of this threshold range. In other implementations, the BC energy data 214 may include the flag, information indicative of the energy value, and so forth.

In other implementations, other comparisons or analyses of the BC signal data 116 may take place. Continuing the earlier example, the BC energy data 214 may include comparing the spectral distribution of energy to determine which portions, if any, of the BC signal data 116 a representative of speech.

Human speech typically exhibits relatively high levels of energy compared to other non-vocal sounds, such as machinery noise. Human speech also typically exhibits energy that is within a particular range of energy values, with that energy distributed across a particular range of frequencies. Signals having an energy value below this range may be assumed to not be representative of speech, while signals having an energy value above this range are also assumed to not be representative of speech. Instead, signals outside of this range of energy values may be deemed not speech and may be disregarded when attempting to determine the voice activity data 122.

By utilizing the techniques described herein, the BC signal data 116 may be analyzed to produce data indicative of presence of speech 216. The data indicative of presence of speech 216 may be indicative of whether speech is deemed to be present in the BC signal data 116. For example, the data indicative of presence of speech 216 may include one or more of the BC ZCR data 206, the BC energy data 214, or other data from other analyses. In other implementations, other techniques may be used to determine the presence of speech in the BC signal data 116. In some implementations, both BC ZCR data 206 and the BC energy data 214 may be used in determining the voice activity data 122. In other implementations, either one or the other may be used to determine the voice activity data 122.

Figure 3:
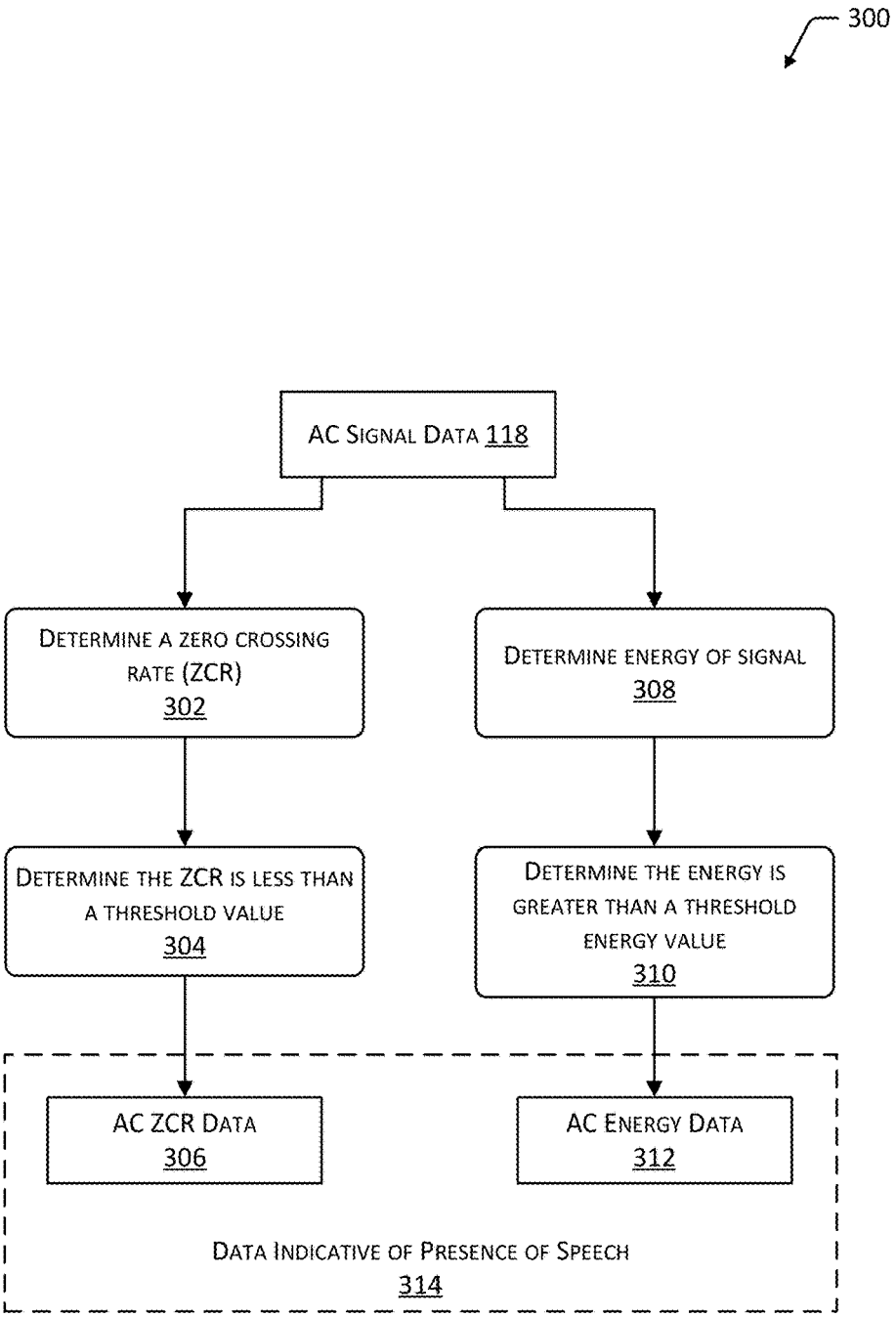
FIG. 3 depicts a flow diagram of a process for determining presence of speech in a signal from an AC microphone, according to some implementations.

FIG. 3 depicts a flow diagram 300 of a process for determining presence of speech in a signal from an AC microphone 112, according to some implementations. The process may be performed at least in part by the HMWD 106.

At 302, zero crossing rate (ZCR) of at least a portion of the AC signal data 118 may be determined. For example, the techniques described above with regard to 202 may be utilized to determine the ZCR of the AC signal data 118.

At 304, the ZCR is determined to be less than a threshold value. AC ZCR data 306 may then be generated that is indicative of this determination. In one implementation, the AC ZCR data 306 may comprise a single bit binary value or flag in which a "1" indicates the AC signal data 118 has a ZCR that is less than a threshold value, while a "0" indicates the AC signal data 118 has a ZCR that is greater than or equal to the threshold value. In other implementations, the AC ZCR data 306 may include the flag, information indicative of the ZCR, and so forth.

At 308, a value indicative of the energy of at least a portion of the AC signal data 118 is determined. For example, the techniques described above with regard to 208 may be utilized to determine the energy of at least a portion of the signal represented by the AC signal data 118.

At 310, the value of the energy is compared to a threshold value and AC energy data 312 is generated. For example, the value of the energy of the AC signal data 118 may be determined to be greater than the threshold energy value. In one implementation, the AC energy data 312 may comprise a single bit binary value or flag in which a "1" indicates the AC signal data 118 has an energy that is within the threshold range, while a "0" indicates the AC signal data 118 has a BC energy value that is outside of this range. In other implementations, the AC energy data 312 may include the flag, information indicative of the energy, and so forth.

By utilizing the techniques described, the AC signal data 118 may be analyzed to produce data indicative of presence of speech 314. The data indicative of presence of speech 314 may be indicative of whether if speech is deemed to be present in the AC signal data 118. For example, the data indicative of presence of speech 314 may include one or more of the AC ZCR data 306, the AC energy data 312, or other data from other analyses. In other implementations, other techniques may be used to determine the presence of speech in the AC signal data 118. In some implementations, both AC ZCR data 306 and the AC energy data 312 may be used in determining the voice activity data 122. In other implementations, either one or the other may be used to determine the voice activity data 122.

Figure 4:
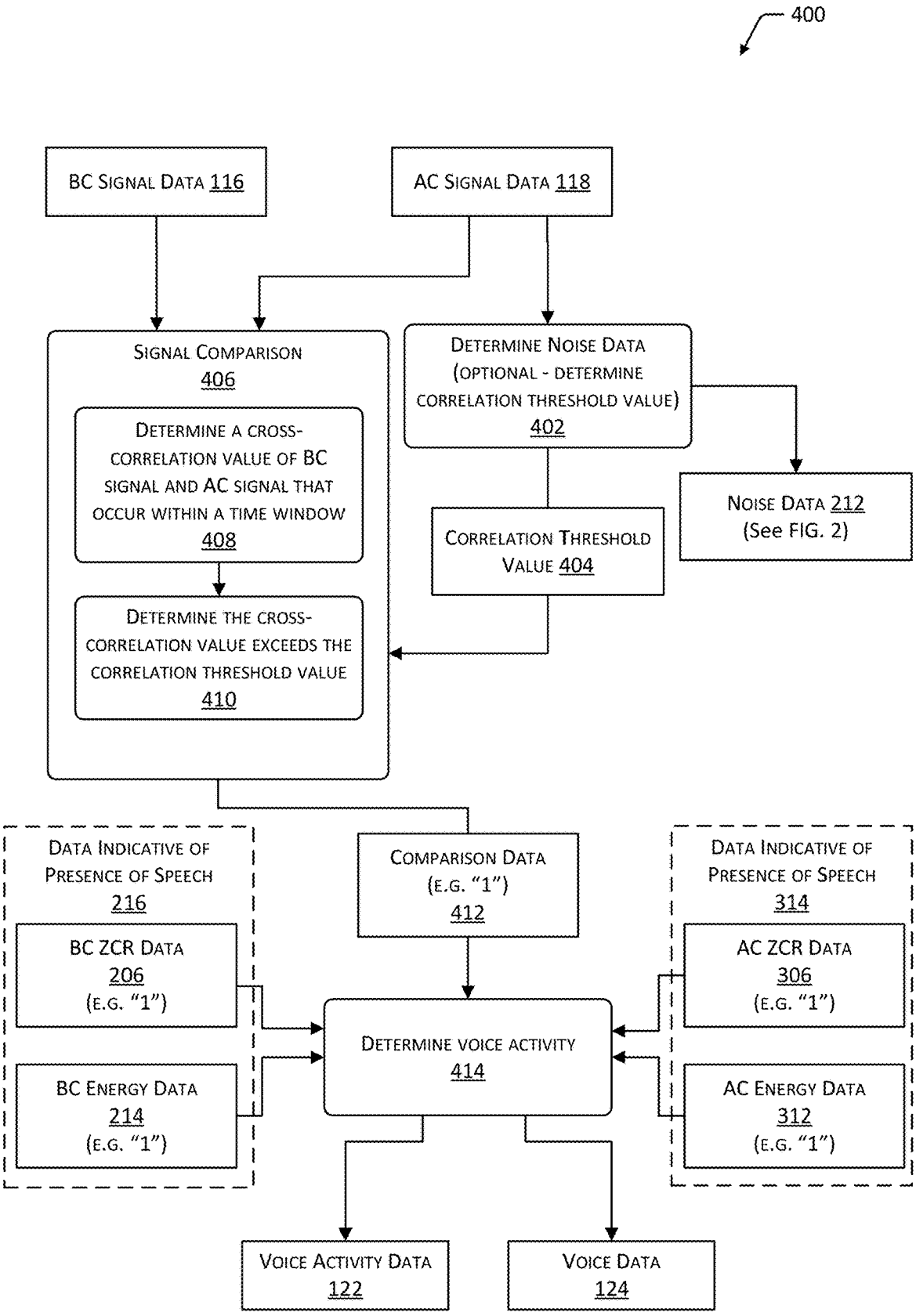
FIG. 4 depicts a flow diagram of a process for determining voice activity data based on information about AC signal data and BC signal data, according to some implementations.

FIG. 4 depicts a flow diagram 400 of a process for determining voice activity data 122 based on information about AC signal data 118 and BC signal data 116, according to some implementations. The process may be performed at least in part by the HMWD 106.

At 402, noise data 212 is determined based on the AC signal data 118. For example, the AC signal data 118 may be processed to determine a maximum detected noise energy, minimum detected noise energy, average detected noise energy, a maximum ZCR, a minimum ZCR, an average ZCR, and so forth. The noise data 212 may be based on the AC signal data 118 obtained while the user 102 was not speaking. For example, during an earlier time at which the voice activity data 122 indicated that the user 102 is not speaking, the AC signal data 118 from that previous time may be used to determine the noise data 212.

At 402 a correlation threshold value 404 may be determined using the noise data 212. For example, the correlation threshold value 404 may indicate a minimum value of correspondence between the BC signal data 116 and the AC signal data 118 that is used to deem that the two signals are representative of the same speech. In some implementations, the correlation threshold value 404 may be based at least in part on the noise data 212. For example, as the average detected noise energy increases, the correlation threshold value 404 may decrease. Continuing this example, in a high noise environment, a lower degree of correlation may be utilized to determine if the two signals are representative of the same speech. In comparison, in a quiet or low noise environment, a higher degree of correlation may be utilized. In one implementation, the determination of the correlation threshold value 404 may use a moving average value that is indicative of the noise indicated by the noise data 212. This moving average value may then be used to retrieve a corresponding correlation threshold value 404 from a lookup table or other data structure.

At 406, signal comparison between the BC signal data 116 and the AC signal data 118 is performed. The signal comparison is used to determine similarity between at least a portion of the BC signal data 116 and the AC signal data 118. In some implementations, the signal comparison 406 may be responsive to a determination that one or more of the prior assessments of the BC signal data 116 and the AC signal data 118 are indicative of the presence of speech. For example, signal comparison 406 may be performed using BC signal data 116 and AC signal data 118 that each have one or more of ZCR data or energy data indicative of the presence of speech.

A variety of different techniques may be used to determine if there is a similarity between the BC signal data 116 and the AC signal data 118. Depicted in this illustration, at 408, a cross-correlation value is determined by performing a cross-correlation function using the BC signal data 116 and the AC signal data 118. For example, the "xcorr" function of MATLAB may be used, or cross-correlation function implemented by an application specific integrated circuit (ASIC) or digital signal processor (DSP) may be used.

In some implementations, the signal comparison 406 may utilize a time window to account for delays associated with the operation or relative position of one or more of the BC microphone 110 or AC microphone 112. The center of the time window may be determined based on a time difference between the propagation of signals with respect to the BC microphone 110 and the AC microphone 112. For example, the AC microphone travel time may be determined by the propagation time of the sound waves from the mouth of the user 102 to the AC microphone 112. The BC microphone travel time may be determined by the propagation time of the vibrations from a vocal tract of the user 102 (such as larynx, throat, mouth, sinuses, etc.) to the location of the BC microphone 110. The width of the time window may be determined by the variation of the time difference among a population of users 102. Portions of the signal data that have timestamps outside of a specified time window may be disregarded from the determination of similarity. For example, the time window may be used to determine which samples in the frames from the BC signal data 116 and the AC signal data 118 are to be assessed using the cross-correlation function. In one implementation, the duration of the time window may be determined based at least in part on the physical distance between the BC microphone 110 and the AC microphone 112 and based on the speed of sound in the ambient atmosphere. The time window may be fixed, while in other implementations, the time window may vary. For example, the time window may vary based at least in part on the noise data 212.

In other implementations, other techniques may be used to determine similarity between the BC signal data 116 and the AC signal data 118. For example, the signal data may be represented as vectors, and distances in a vector space between the vectors of the different signals may calculated. The closer the distance in the vector space, the greater the similarity between the data being compared. In another implementation, instead of or in addition to cross-correlation, a convolution operation may be used to determine similarity between the signals.

At 410 the cross-correlation value is determined to exceed the correlation threshold value 404 and comparison data 412 indicative of this determination is generated. In other implementations, using other techniques to determine similarity or other thresholds to be used. As a result of this determination, the BC signal data 116 and the AC signal data 118 are deemed to be representative of a common source, such as speech obtained from the user 102.

The comparison data 412 may comprise a single bit binary value or flag in which a "1" indicates the two signals are correlated sufficiently to be deemed indicative of the same source, while a "0" indicates the two signals are not indicative of the same source. In other implementations, the comparison data 412 may include the flag, information indicative of the degree of correlation, and so forth.

At 414, voice activity data 122 is determined. This determination is based on one or more of the comparison data 412, the BC ZCR data 206, the BC energy data 214, the AC ZCR data 306, the AC energy data 312, and so forth. For example, if the comparison data 412 indicates that the two signals are highly correlated (that is above a threshold and indicative of the same source), and the BC ZCR data 206, the BC energy data 214, the AC ZCR data 306, and the AC energy data 312 are all indicative of speech being present within signals, voice activity data 122 may be generated that indicates the user 102 wearing the HMWD 106 is speaking.

In other implementations, various combinations of the information about the signals may be used to generate the voice activity data 122. For example, data indicative of speech in both the BC signal data 116 and the AC signal data 118 may result in voice activity data 122 indicative of speech. Continuing the example, the BC ZCR data 206 and the BC energy data 214 may indicate the presence of speech, as does the AC ZCR data 306 and the AC energy data 312. A binary "AND" operation may be used between these pieces of single bit data to determine the voice activity data 122, such that when all inputs are indicative of the presence of speech, the voice activity data 122 is indicative of speech.

In other implementations, other data indicative of speech may be determined in the BC signal data 116 and the AC signal data 118. Different techniques, algorithms, or processes may be used for the different signal data. For example, the BC signal data 116 may be processed to determine the ZCR for a particular frame exceeds a threshold value, while the AC signal data 118 is processed using spectral analysis to determine the spectra of the signal in the frame is consistent with human speech.

One implementation of the processes described by FIGS. 2-4 is reproduced below as implemented using version R2015a of MATLAB software by Mathworks, Inc. of Natick, Mass., USA.

```
function varargout = bcVadGui1207_OutputFcn(hObject, eventdata, handles)
global status
%% Create and Initialize
SamplesPerFrame = 441*5;          % Samples per frame, 50 ms
czrThrdBC = 0.15;                 % zero-cross-rate higher threshold, bone-conduction
energyThrdBC = 5e-6;              % energy lower threshold, BC
energyMaxBC = 5e-4;               % energy maxima, bone-conduction
czrThrdAC = 0.15;                 % zero-cross-rate higher threshold, air-conduction
energyThrdAC = 3e-5;              % energy lower threshold, AC
xcorrThrd = 0.03;                 % cross-correlation lower threshold
Microphone = dsp.AudioRecorder('SamplesPerFrame',SamplesPerFrame);          %
loading mic device
uiwait(gcf);
tic;
h = findobj('Tag', 'text2');
while status
  %% BC channel calculation
  audioIn = step (Microphone);                % reading audio data
  x0BC = audioIn(:, 1);                       % left channel => BC audio stream
  x0BC = x0BC';
  x1BC = [x0BC(2 : end), 0];                  % preparation for zero-cross-rate calculation
  energyBC = sum(x0BC.^2)/SamplesPerFrame;                    % energy calculation
  czrBC = sum(0.5 * abs(sign(x0BC) - sign(x1BC)))/SamplesPerFrame;
                                                        % zero-cross-rate calculation
 %% AC channel calculation, similar to BC
  x0AC = audioIn(:, 2);
  x0AC = x0AC';
  x1AC = [x0AC(2 : end), 0];
  energyAC = sum(x0AC.^2)/SamplesPerFrame;
  czrAC = sum(0.5 * abs(sign(x0AC) - sign(x1AC)))/SamplesPerFrame;
  %% Cross-correlation calculation
  [xcorrBCAC, ~] = xcorr(x0BC, x0AC);                 % cross-correlation calculation
  windowedXcorr = xcorrBCAC(2261:2287);               % time-windowing, only check
samples of interest
  %% Triggering conditions
  if czrBC < czrThrdBC && . . .                          % check the BC zero-cross-rate
          energyBC > energyThrdBC && . . .               % check the BC energy lower limit
          energyBC < energyMaxBC && . . .                % check the BC energy higher limit
```

-continued

```
            czrAC < czrThrdAC && . . .                    % check the AC zero-cross-rate
            energyAC > energyThrdAC && . . .              % check the AC energy lower limit
            max(windowedXcorr) > xcorrThrd                  % check the cross-correlation lower limit
        display('Voice detected!');
        set(h, 'string', 'Voice detected!' );
        set(h, 'ForegroundColor', 'red');
        pause(eps);
    else
        display('0')
        set(h, 'string', 'No Voice Activity.');
        set(h, 'ForegroundColor', 'blue');
        pause(eps);
    end
end
release (Microphone);
varargout{1} = handles.output;
end
```

Code Example 1

The voice data 124 may be generated contemporaneously with the processes described above. For example, the voice data 124 may comprise the BC signal data 116, AC signal data 118, or a combination of the BC signal data 116 and the AC signal data 118.

By being able to determine when the user 102 of the HMWD 106 is speaking, the system may be responsive to the speech of the user 102 while minimizing or eliminating erroneous actions resulting from the noise 114. For example, when the voice activity data 122 indicates that the user 102 speaking, the voice data 124 may be processed to identify verbal commands.

Figure 5:
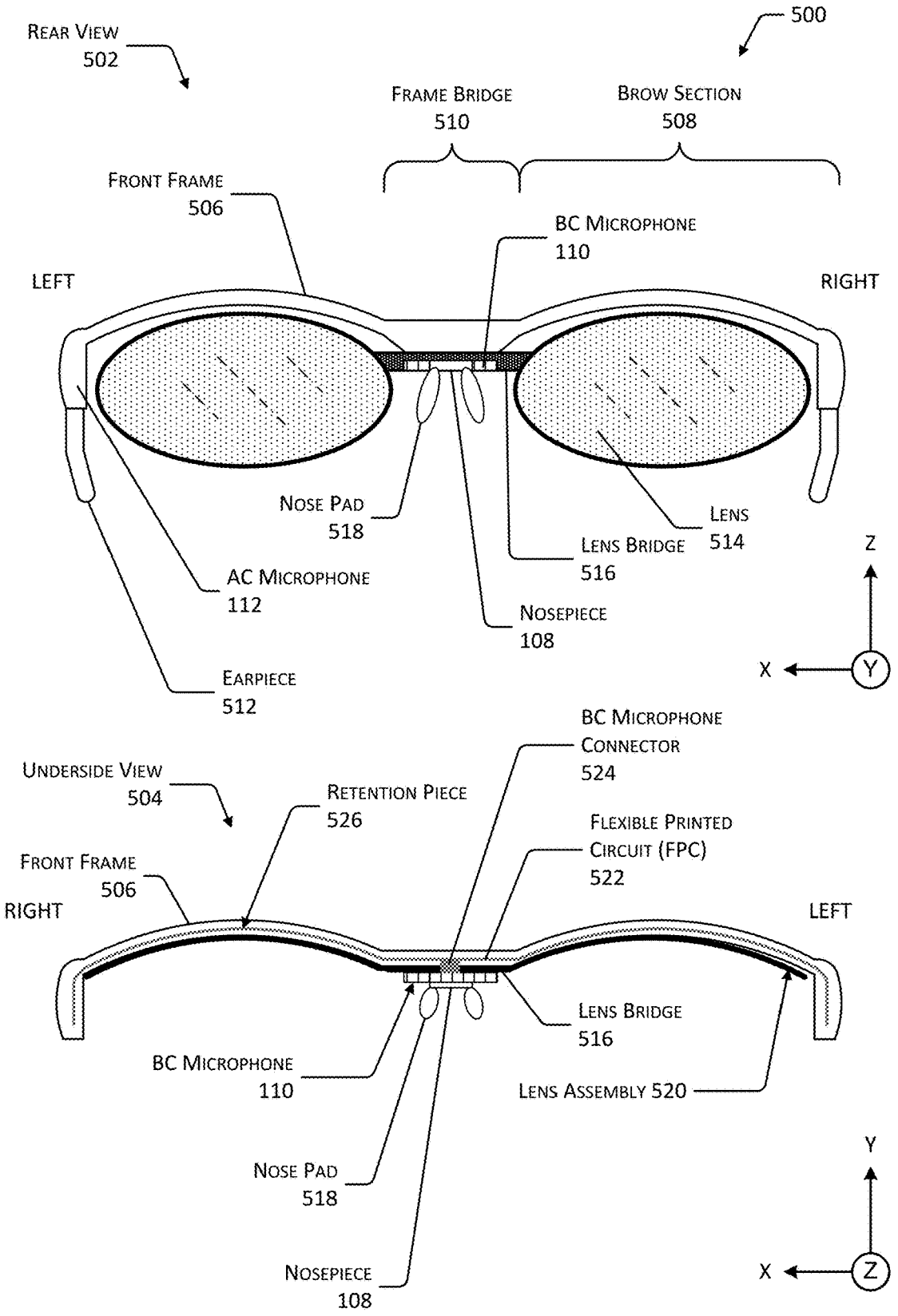
FIG. 5 depicts views of the head-mounted wearable device, according to some implementations.

FIG. 5 depicts views 500 of the HMWD 106, according to some implementations. A rear view 502 shows the exterior appearance of the HMWD 106 while an underside view 504 shows selected components of the HMWD 106.

In the rear view 502, a front frame 506 is depicted. The front frame 506 may include a left brow section 508(L) and a right brow section 508(R) that are joined by a frame bridge 510. In some implementations, the front frame 506 may comprise a single piece of material, such as a metal, plastic, ceramic, composite material, and so forth. For example, the front frame 506 may comprise 6061 aluminum alloy that has been milled to the desired shape. In other implementations, the front frame 506 may comprise several discrete pieces that are joined together by way of mechanical engagement features, welding, adhesive, and so forth. Also depicted extending from temples or otherwise hidden from view are earpieces 512. In the implementation depicted here, the AC microphone 112 is shown proximate to the left side of the front frame 506. For example, the AC microphone 112 may be located next to a hinge (not shown here).

In some implementations, the HMWD 106 may include one or more lenses 514. The lenses 514 may have specific refractive characteristics, such as in the case of prescription lenses. The lenses 514 may be clear, tinted, photochromic, electrochromic, and so forth. For example, the lenses 514 may comprise plano (non-prescription) tinted lenses to provide protection from the sun. The lenses 514 may be joined to each other or to a portion of the frame bridge 510 by way of a lens bridge 516. The lens bridge 516 may be located between the left lens 514(L) and the right lens 514(R). For example, the lens bridge 516 may comprise a member that joins a left lens 514(L) and a right lens 514(R) and affixes to the frame bridge 510. The nosepiece 108 may be affixed to one or more of the front frame 506, the frame bridge 510, the lens bridge 516, or the lenses 514. The BC microphone 110 may be arranged at a mechanical interface between the nosepiece 108 and the front frame 506, the frame bridge 510, the lens bridge 516, or the lenses 514.

One or more nose pads 518 may be attached to the nosepiece 108. The nose pads 518 aid in the support of the front frame 506 and may improve comfort of the user 102. A lens assembly 520 comprises the lenses 514 and the lens bridge 516. In some implementations, the lens assembly 520 may be omitted from the HMWD 106.

The underside view 504 depicts a front frame 506. One or more electrical conductors, optical fibers, transmission lines, and so forth, may be used to connect various components of the HMWD 106. In this illustration, arranged within a channel is a flexible printed circuit (FPC) 522. The FPC 522 allows for an exchange of signals, power, and so forth, between devices in the HMWD 106, such as the BC microphone 110, the left and the right side of the front frame 506, and so forth. For example, the FPC 522 may be used to provide connections for electrical power and data communications between electronics in one or both of the temples of the HMWD 106 and the BC microphone 110.

In some implementations, the FPC 522 may be substantially planar or flat. The FPC 522 may include one or more of electrical conductors, optical waveguides, radiofrequency waveguides, and so forth. For example, the FPC 522 may include copper traces to convey electrical power or signals, optical fibers to act as optical waveguides and convey light, radiofrequency waveguides to convey radio signals, and so forth. In one implementation, the FPC 522 may comprise a flexible flat cable in which a plurality of conductors is arranged such that they have a substantially linear cross-section overall.

The FPC 522 may be planar in that the FPC 522 has a substantially linear or rectangular cross-section. For example, with the electrical conductors or other elements of the FPC 522 may be within a common plane, such as during fabrication, and may be subsequently bent, rolled, or otherwise flexed.

The FPC 522 may comprise one or more conductors placed on an insulator. For example, the FPC 522 may comprise electrically conductive ink that has been printed onto a plastic substrate. Conductors used with the FPC 522 may include, but are not limited to, rolled annealed copper, electro deposited copper, aluminum, carbon, silver ink, austenite nickel-chromium alloy, copper-nickel alloy, and so forth. Insulators may include, but are not limited to, polyimide, polyester, screen printed dielectric, and so forth. In one implementation, the FPC 522 may comprise a plurality of electrical conductors laminated to polyethylene terephthalate film (PET) substrate. In another implementation, the FPC 522 may comprise a plurality of conductors that are lithographically formed onto a polymer film. For example, photolithography may be used to catch or otherwise form copper pathways. In yet another implementation, the FPC 522 may comprise a plurality of conductors that have been printed or otherwise deposited onto a substrate that is substantially flexible.

The FPC 522 may be deemed to be flexible when it is able to withstand one or more of bending around a predefined radius or twisting or torsion at a predefined angle while remaining functional to the intended purpose and without permanent damage. Flexibility may be proportionate to the thickness of the material. For example, PET that is less than 550 micrometers thick may be deemed flexible, while the same PET having a thickness of 5 millimeters may be deemed inflexible.

The FPC 522 may include one or more layers of conductors. For example, one layer may comprise copper traces to carry electrical power and signals and a second layer may comprise optical fibers to carry light signals. A BC microphone connector 524 may provide electrical, optical, radio frequency, acoustic, or other connectivity between the BC microphone 110 and another device, such as the FPC 522. In some implementations, the BC microphone connector 524 may comprise a section or extension of the FPC 522. In other implementations, the BC microphone connector 524 may comprise a discrete piece, such as wiring, conductive foam, flexible printed circuit, and so forth. The BC microphone connector 524 may be configured to transfer electrical power, electrical signals, optical signals, and so forth, between the BC microphone 110 and devices, such as the FPC 522.

A retention piece 526 may be placed between the FPC 522 within the channel and the exterior environment. The retention piece 526 may comprise a single piece or several pieces. The retention piece 526 may comprise an overmolded component, a channel seal, a channel cover, and so forth. For example, the material comprising the retention piece 526 may be formed into the channel while in one or more of a powder, liquid or semi-liquid state. The material may subsequently harden into a solid or semi-solid shape. Hardening may occur as a result of time, application of heat, light, electric current, and so forth. In another example, the retention piece 526 may be affixed to the channel or a portion thereof using adhesive, pressure, and so forth. In yet another example, the retention piece 526 may be formed within the channel using an additive technique, such as using an extrusion head to deposit a plastic or resin within the channel, a laser to sinter a powdered material, and so forth. In still another example, the retention piece 526 may comprise a single piece produced using injection molding techniques. In some implementations, the retention piece 526 may comprise an overmolded piece. The FPC 522 may be maintained within the channel by the retention piece 526. The retention piece 526 may also provide devices within the channel with protection from environmental contaminants such as dust, water, and so forth.

The retention piece 526 may be sized to retain the FPC 522 within the channel. The retention piece 526 may include one or more engagement features. The engagement features may be used to facilitate retention of the retention piece 526 within the channel of the front frame 506. For example, the distal ends of the retention piece 526 may include protrusions configured to engage a corresponding groove or receptacle within a portion of the front frame 506. Instead of, or in addition to the engagement features, an adhesive may be used to bond at least a portion of the retention piece 526 to at least a portion of the channel in the front frame 506.

The retention piece 526 may comprise a single material, or a combination of materials. The material may comprise one or more of an elastomer, a polymer, a ceramic, a metal, a composite material, and so forth. The material of the retention piece 526 may be rigid or elastomeric. For example, the retention piece 526 may comprise a metal or a resin. In implementations where the retention piece 526 is rigid, a retention feature such as a tab or slot may be used to maintain the retention piece 526 in place in the channel of the front frame 506. In another example, the retention piece 526 may comprise a silicone plastic, a room temperature vulcanizing rubber, or other elastomer.

One or more components of the HMWD 106 may comprise single unitary pieces or may comprise several discrete pieces. For example, the front frame 506, the nosepiece 108, and so forth, may comprise a single piece, or may be constructed from several pieces joined or otherwise assembled.

In some implementations, the front frame 506 may be used to retain the lenses 514. For example, the front frame 506 may comprise a unitary piece or assembly that encompasses at least a portion of a perimeter of each lens.

Figure 6:
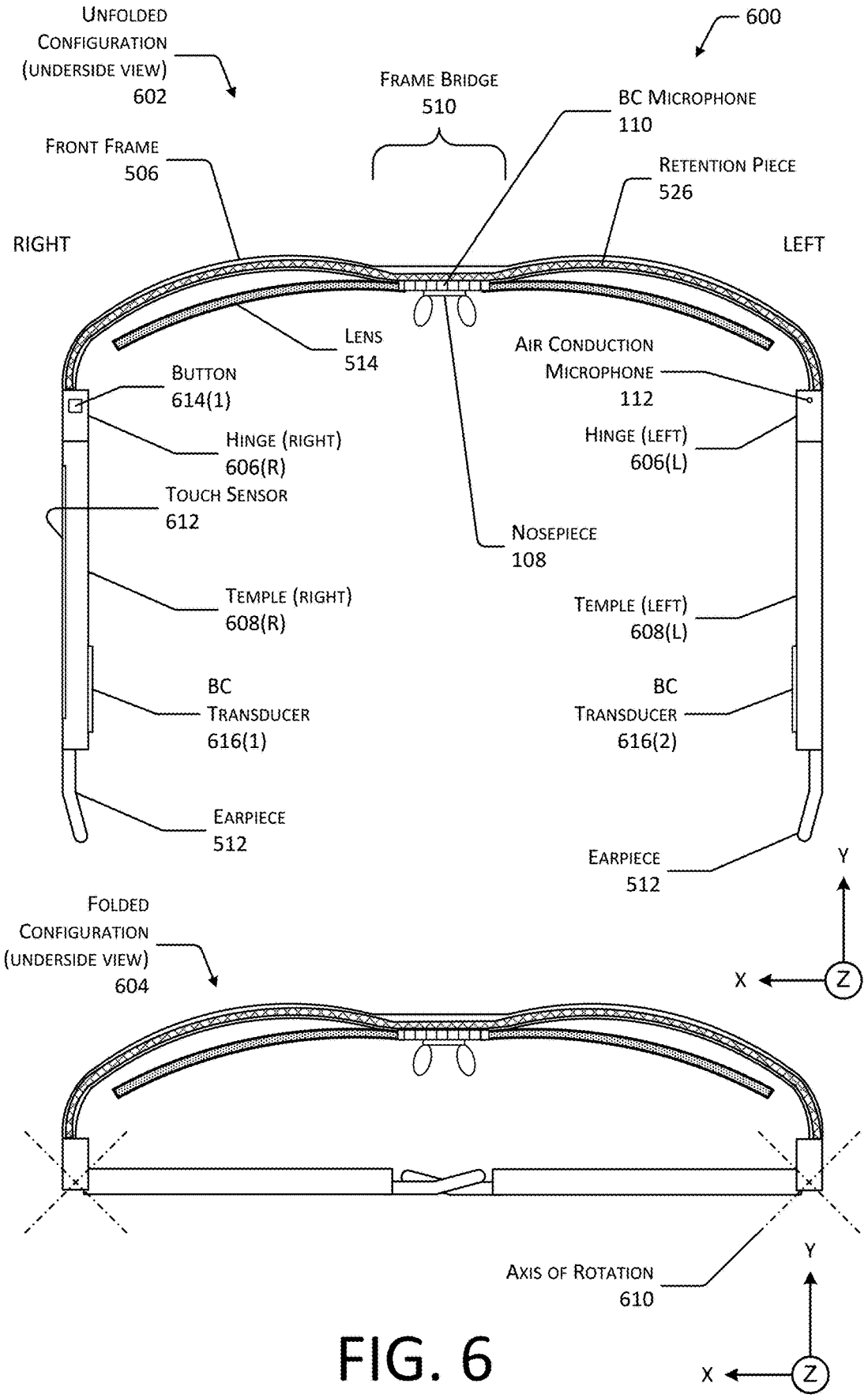
FIG. 6 depicts an exterior view, from below, of the head-mounted wearable device in unfolded and folded configurations, according to some implementations.

FIG. 6 depicts exterior views 600, from below looking up, of the HMWD 106, including a view in an unfolded configuration 602 and a view in a folded configuration 604, according to some implementations. The retention piece 526 that is placed within a channel of the front frame 506 is visible in this view from underneath the HMWD 106.

Also visible in this view are the lenses 514 of the lens assembly 520. Because the lens assembly 520 is affixed to the front frame 506 at the frame bridge 510, the front frame 506 may flex without affecting the positioning of the lenses 514 with respect to the eyes of the user 102. For example, when the head 104 of the user 102 is relatively large, the front frame 506 may flex away from the user's head 104 to accommodate the increased distance between the temples. Similarly, when the head 104 of the user 102 is relatively small, the front frame 506 may flex towards the user's head 104 to accommodate the decreased distance between the temples.

One or more hinges 606 may be affixed to, or an integral part of, the front frame 506. Depicted are a left hinge 606(L) and a right hinge 606(R) on the left and right sides of the front frame 506, respectively. The left hinge 606(L) is arranged at the left brow section 508(L), distal to the frame bridge 510. The right hinge 606(R) is arranged at the right brow section 508(R) distal to the frame bridge 510.

A temple 608 may couple to a portion of the hinge 606. For example, the temple 608 may comprise one or more components, such as a knuckle, that mechanically engage one or more corresponding structures on the hinge 606.

The left temple 608(L) is attached to the left hinge 606(L) of the front frame 506. The right temple 608(R) is attached to the right hinge 606(R) of the front frame 506.

The hinge 606 permits rotation of the temple 608 with respect to the hinge 606 about an axis of rotation 610. The hinge 606 may be configured to provide a desired angle of rotation. For example, the hinge 606 may allow for a rotation of between 0 and 120 degrees. As a result of this rotation, the HMWD 106 may be placed into a folded configuration, such as shown at 604. For example, each of the hinges 606 may rotate by about 90 degrees, such as depicted in the folded configuration 604.

One or more of the front frame 506, the hinge 606, or the temple 608 may be configured to dampen the transfer of vibrations between the front frame 506 and the temples 608. For example, the hinge 606 may incorporate vibration dampening structures or materials to attenuate the propagation of vibrations between the front frame 506 and the temples 508. These vibration dampening structures may include elastomeric materials, springs, and so forth. In another example, the portion of the temple 608 that connects to the hinge 606 may comprise an elastomeric material.

One or more different sensors may be placed on the HMWD 106. For example, the BC microphone 110 may be located at the frame bridge 510 while the AC microphone 112 may be emplaced within or proximate to the left hinge 606(L), such as on the underside of the left hinge 606(L). The BC microphone 110 and the AC microphone 112 are maintained at a fixed distance relative to one another during operation. For example, the relatively rigid frame of the HMWD 106 maintains the spacing between the BC microphone 110 and the AC microphone 112. While the BC microphone 110 is depicted proximate to the frame bridge 510, in other implementations, the BC microphone 110 may be positioned at other locations. For example, the BC microphone 110 may be located in one or both of the temples 608.

A touch sensor 612 may be located on one or more of the temples 608. One or more buttons 614 may be placed in other locations on the HMWD 106. For example, a button 614(1) may be emplaced within, or proximate to, the right hinge 606(R), such as on an underside of the left hinge 606(R).

One or more bone conduction (BC) transducers 616 may be emplaced on the temples 608. For example, as depicted here, a BC transducer 616(1) may be located on the surface of the temple 608(R) that is proximate to the head 104 of the user 102 during use. Continuing the example, as depicted here, a BC transducer 616(2) may be located on the surface of the temple 608(L) that is proximate to the head 104 of the user 102 during use. The BC transducer 616 may be configured to generate acoustic output. For example, the BC transducer 616 may comprise a piezoelectric speaker that provides audio to the user 102 via bone conduction through the temporal bone of the head 104. In some implementations, the BC transducer 616 may be used to provide the functionality of the BC microphone 110. For example, the BC transducer 616 may be used to detect vibrations of the user's 102 head 104.

The earpiece 512 may extend from a portion of the temple 608 that is distal to the front frame 506. The earpiece 512 may comprise a material that may be reshaped to accommodate the anatomy of the head 104 of the user 102. For example, the earpiece 512 may comprise a thermoplastic that may be warmed to predetermined temperature and reshaped. In another example, the earpiece 512 may comprise a wire that may be bent to fit. The wire may be encased in an elastomeric material.

The FPC 522 provides connectivity between the electronics in the temples 608. For example, the left temple 608(L) may include electronics such as a hardware processor while the right temple 608(R) may include electronics such as a battery. The FPC 522 provides a pathway for control signals from the hardware processor to the battery, may transfer electrical power from the battery to the hardware processor, and so forth. The FPC 522 may provide additional functions such as providing connectivity to the AC microphone 112, the button 614(1), components within the front frame 506, and so forth. For example, a front facing camera may be mounted within the frame bridge 510 and may be connected to the FPC 522 to provide image data to the hardware processor in the temple 608.

Figure 7:
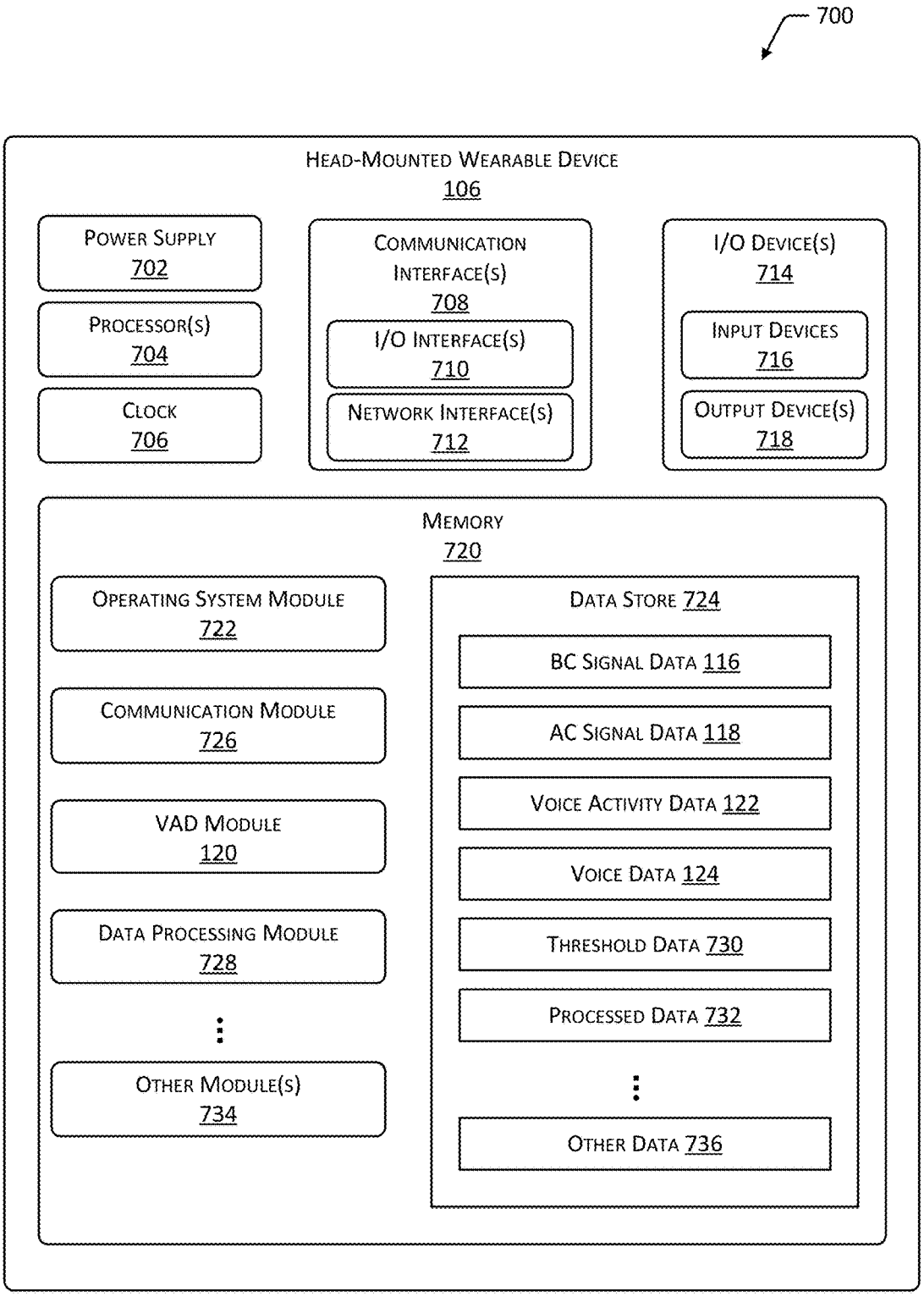
FIG. 7 is a block diagram of electronic components of the head-mounted wearable device, according to some implementations.

FIG. 7 is a block diagram 700 of electronic components of the HMWD 106, according to some implementations.

One or more power supplies 702 may be configured to provide electrical power suitable for operating the components in the HMWD 106. The one or more power supplies 702 may comprise batteries, capacitors, fuel cells, photovoltaic cells, wireless power receivers, conductive couplings suitable for attachment to an external power source such as provided by an electric utility, and so forth. For example, the batteries on board the HMWD 106 may be charged wirelessly, such as through inductive power transfer. In another implementation, electrical contacts may be used to recharge the HMWD 106.

The HMWD 106 may include one or more hardware processors 704 (processors) configured to execute one or more stored instructions. The processors 704 may comprise one or more cores. One or more clocks 706 may provide information indicative of date, time, ticks, and so forth. For example, the processor 704 may use data from the clock 706 to associate a particular interaction with a particular point in time.

The HMWD 106 may include one or more communication interfaces 708 such as input/output (I/O) interfaces 710, network interfaces 712, and so forth. The communication interfaces 708 enable the HMWD 106, or components thereof, to communicate with other devices or components. The communication interfaces 708 may include one or more I/O interfaces 710. The I/O interfaces 710 may comprise Inter-Integrated Circuit (I2C), Serial Peripheral Interface bus (SPI), Universal Serial Bus (USB) as promulgated by the USB Implementers Forum, RS-232, and so forth.

The I/O interface(s) 710 may couple to one or more I/O devices 714. The I/O devices 714 may include input devices 716 such as one or more sensors, buttons, and so forth. The input devices 716 include the BC microphone 110 and the AC microphone 112. The microphones may generate analog time-varying voltage signals. These analog signals may vary from a negative polarity to a positive polarity. These analog signals may then be sampled by an ADC to produce a digital representation of the analog signals. Additional processing may be performed to the analog signal, the digital signal, or both. For example, the additional processing may comprise filtering, normalization, and so forth. In some implementations, the microphones may generate digital output, such as a PDM signal that is subsequently processed.

The sampling rate used to generate the digital signals may vary. For example, where the output is digital PDM data obtained from a PDM modulator, a master clock frequency of about 3 MHz may be used to provide an oversampling ratio of 64, resulting in a bandwidth of 24 kHz. In comparison, if the digital output is provided as PCM, the system may be sampled at 48 kHz (which is comparable to the PDM bandwidth of 24 kHz).

The I/O devices 714 may also include output devices 718 such as one or more of a display screen, display lights, audio speakers, and so forth. The output devices 718 are configured to generate signals, which may be perceived by the user 102 or may be detected by sensors. In some embodiments, the I/O devices 714 may be physically incorporated with the HMWD 106 or may be externally placed.

Haptic output devices 718(1) are configured to provide a signal that results in a tactile sensation to the user 102. The haptic output devices 718(1) may use one or more mechanisms such as electrical stimulation or mechanical displacement to provide the signal. For example, the haptic output devices 718(1) may be configured to generate a modulated electrical signal, which produces an apparent tactile sensation in one or more fingers of the user 102. In another example, the haptic output devices 718(1) may comprise piezoelectric or rotary motor devices configured to provide a vibration, which may be felt by the user 102. In some implementations, the haptic output devices 718(1) may be used to produce vibrations that may be transferred to one or more bones in the head 104, producing the sensation of sound. For example, while providing haptic output, the vibrations may be in the range of between 0.5 and 500 Hertz (Hz), while vibrations provided to produce the sensation of sound may be between 50 and 50,000 Hz.

One or more audio output devices 718(2) may be configured to provide acoustic output. The acoustic output includes one or more of infrasonic sound, audible sound, or ultrasonic sound. The audio output devices 718(2) may use one or more mechanisms to generate the acoustic output. These mechanisms may include, but are not limited to, the following: voice coils, piezoelectric elements, magnetorestrictive elements, electrostatic elements, and so forth. For example, a piezoelectric buzzer or a speaker may be used to provide acoustic output. The acoustic output may be transferred by the vibration of intervening gaseous and liquid media, such as adding air, or by direct mechanical conduction. For example, the BC transducer 616 may be located within the temple 608 and used as an audio output device 718(2). The BC transducer 616 may provide an audio signal to the user 102 of the HMWD 106 by way of bone conduction to the user's 102 skull, such as the mastoid process or temporal bone. In some implementations, the speaker or sound produced therefrom may be placed within the ear of the user 102, or may be ducted towards the ear of the user 102.

The display output devices 718(3) may be configured to provide output, which may be seen by the user 102 or detected by a light-sensitive sensor such as a camera or an optical sensor. In some implementations, the display output devices 718(3) may be configured to produce output in one or more of infrared, visible, or ultraviolet light. The output may be monochrome or color.

The display output devices 718(3) may be emissive, reflective, or both. An emissive display output device 718(3), such as using light emitting diodes (LEDs), is configured to emit light during operation. In comparison, a reflective display output device 718(3), such as using an electrophoretic element, relies on ambient light to present an image. Backlights or front lights may be used to illuminate non-emissive display output devices 718(3) to provide visibility of the output in conditions where the ambient light levels are low.

The display output devices 718(3) may include, but are not limited to, micro-electromechanical systems (MEMS), spatial light modulators, electroluminescent displays, quantum dot displays, liquid crystal on silicon (LCOS) displays, cholesteric displays, interferometric displays, liquid crystal displays (LCDs), electrophoretic displays, and so forth. For example, the display output device 718(3) may use a light source and an array of MEMS-controlled mirrors to selectively direct light from the light source to produce an image. These display mechanisms may be configured to emit light, modulate incident light emitted from another source, or both. The display output devices 718(3) may operate as panels, projectors, and so forth.

The display output devices 718(3) may include image projectors. For example, the image projector may be configured to project an image onto a surface or object, such as the lens 514. The image may be generated using MEMS, LCOS, lasers, and so forth.

Other display output devices 718(3) may also be used by the HMWD 106. Other output devices 718(P) may also be present. For example, the other output devices 718(P) may include scent/odor dispensers.

The network interfaces 712 may be configured to provide communications between the HMWD 106 and other devices, such as the server 128. The network interfaces 712 may include devices configured to couple to personal area networks (PANs), wired or wireless local area networks (LANs), wide area networks (WANs), and so forth. For example, the network interfaces 712 may include devices compatible with Ethernet, Wi-Fi®, Bluetooth®, Bluetooth® Low Energy, ZigBee®, and so forth.

The HMWD 106 may also include one or more busses or other internal communications hardware or software that allow for the transfer of data between the various modules and components of the HMWD 106.

As shown in FIG. 7, the HMWD 106 includes one or more memories 720. The memory 720 may comprise one or more non-transitory computer-readable storage media (CRSM). The CRSM may be any one or more of an electronic storage medium, a magnetic storage medium, an optical storage medium, a quantum storage medium, a mechanical computer storage medium, and so forth. The memory 720 provides storage of computer-readable instructions, data structures, program modules, and other data for the operation of the HMWD 106. A few example functional modules are shown stored in the memory 720, although the same functionality may alternatively be implemented in hardware, firmware, or as a system on a chip (SoC).

The memory 720 may include at least one operating system (OS) module 722. The OS module 722 is configured to manage hardware resource devices such as the I/O interfaces 710, the I/O devices 714, the communication interfaces 708, and provide various services to applications or modules executing on the processors 704. The OS module 722 may implement a variant of the FreeBSD™ operating system as promulgated by the FreeBSD Project; other UNIX™ or UNIX-like variants; a variation of the Linux™ operating system as promulgated by Linus Torvalds; the Windows® operating system from Microsoft Corporation of Redmond, Wash., USA; and so forth.

Also stored in the memory 720 may be a data store 724 and one or more of the following modules. These modules may be executed as foreground applications, background tasks, daemons, and so forth. The data store 724 may use a flat file, database, linked list, tree, executable code, script, or other data structure to store information. In some implementations, the data store 724 or a portion of the data store 724 may be distributed across one or more other devices including servers 128, network attached storage devices, and so forth.

A communication module 726 may be configured to establish communications with one or more of the other HMWDs 106, servers 128, sensors, or other devices. The communications may be authenticated, encrypted, and so forth.

The VAD module 120 may be implemented at least in part as instructions executing on the processor 704. In these implementations, the VAD module 120 may be stored at least in part within the memory 720. The VAD module 120 may perform one or more of the functions described above with regard to FIGS. 2-4. In other implementations, the VAD module 120 or functions thereof may be performed using one or more of dedicated hardware, analog circuitry, mixed mode analog and digital circuitry, digital circuitry, and so forth. For example, the VAD module 120 may comprise a dedicated processor.

In another implementation, the VAD module 120 may be implemented at the server 128. For example, the server 128 may receive the BC signal data 116 and the AC signal data 118, and may generate the voice activity data 122 separately from the HMWD 106.

During operation of the system, the data store 724 may store other data. For example, at least a portion of the BC signal data 116, the AC signal data 118, the voice activity data 122, voice data 124, and so forth, may be stored at least temporarily in the data store 724.

The memory 720 may also store data processing module 728. The data processing module 728 may provide one or more of the functions described herein. For example, the data processing module 728 may be configured to awaken the HMWD 106 from a sleep state, perform natural language processing, and so forth. The data processing module 728 may use the voice activity data 122 generated by the VAD module 120. For example, voice activity data 122 indicative of the user 102 speaking may be used to awaken the HMWD 106 from the sleep state, may indicate that the signal data is to be processed to determine the information being conveyed by the speech of the user 102, and so forth.

The modules may utilize other data during operation. For example, the data processing module 728 may utilize threshold data 730 during operation. In another example, the VAD module 120 may access threshold data 730 indicative of minimum energy thresholds, maximum energy thresholds, ZCR thresholds, and so forth. The threshold data 730 may specify one or more thresholds, limits, ranges, and so forth. For example, the threshold data 730 may indicate permissible tolerances or variances. The data processing module 728 or other modules may generate processed data 732. For example, the processed data 732 may comprise a transcription of audio spoken by the user 102, image data to present, and so forth.

Techniques such as artificial neural networks (ANN), active appearance models (AAM), active shape models (ASM), principal component analysis (PCA), cascade classifiers, and so forth, may also be used to process the voice data 124. For example, the ANN may be trained using a supervised learning algorithm such that particular sounds or changes in orientation of the user's 102 head 104 are associated with particular actions to be taken. Once trained, the ANN may be provided with the voice data 124 and provide, as output, a transcription of the words spoken by the user 102, orientation of the user's 102 head 104, and so forth.

Other modules 734 may also be present in the memory 720 as well as other data 736 in the data store 724. For example, the other modules 734 may include a contact management module while the other data 736 may include address information associated with a particular contact, such as an email address, telephone number, network address, uniform resource locator, and so forth.

The processes discussed herein may be implemented in hardware, software, or a combination thereof. In the context of software, the described operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Embodiments may be provided as a software program or computer program product including a non-transitory computer-readable storage medium having stored thereon instructions (in compressed or uncompressed form) that may be used to program a computer (or other electronic device) to perform processes or methods described herein. The computer-readable storage medium may be one or more of an electronic storage medium, a magnetic storage medium, an optical storage medium, a quantum storage medium, and so forth. For example, the computer-readable storage media may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further, embodiments may also be provided as a computer program product including a transitory machine-readable signal (in compressed or uncompressed form). Examples of transitory machine-readable signals, whether modulated using a carrier or unmodulated, include but are not limited to signals that a computer system or machine hosting or running a computer program can be configured to access, including signals transferred by one or more networks. For example, the transitory machine-readable signal may comprise transmission of software by the Internet.

Separate instances of these programs can be executed on or distributed across any number of separate computer systems. Thus, although certain steps have been described as being performed by certain devices, software programs, processes, or entities, this need not be the case and a variety of alternative implementations will be understood by those having ordinary skill in the art.

Specific physical embodiments as described in this disclosure provided by way of illustration and not necessarily as a limitation. Those having ordinary skill in the art readily recognize that alternative implementations, variations, and so forth may also be utilized in a variety of devices, environments, and situations. Although the subject matter has been described in language specific to structural features or methodological acts, it is to be understood that the subject matter defined in the appended claims is not necessarily limited to the specific features or acts described. Rather, the specific features, structures, and acts are disclosed as exemplary forms of implementing the claims.

What is claimed is:

1. A head-mounted wearable device comprising:

a bone conduction (BC) microphone;

an air conduction (AC) microphone; and electronics to:

determine first BC signal data indicative of an absence of speech from the BC microphone at a first time;

determine first AC signal data from the AC microphone that is associated with the first time;

determine noise data based on the first AC signal data associated with the first time;

determine second BC signal data indicative of a presence of speech from the BC microphone at a second time;

determine second AC signal data that is associated with the second time;

determine a correlation threshold value based on the noise data, the correlation threshold value representing a minimum value of correspondence between the second AC signal data and the second BC signal data that indicates the second AC signal data and the second BC signal data are representative of a same speech;

determine that a cross-correlation between the second AC signal data and the second BC signal data exceeds the correlation threshold value;

determine, based on the cross-correlation exceeding the correlation threshold value, that the second AC signal data and the second BC signal data are representative of the same speech; and based on determining the second AC signal data and the second BC signal data are representative of the same speech, trigger an action including eliminating noise data from the second AC signal data.

2. The head-mounted wearable device of claim 1, the electronics performing one or more of determining the second BC signal data or determining the second AC signal data by:

determining, for a frame of the second BC signal data or the second AC signal data comprising a plurality of sample values representative of a signal, a zero crossing rate (ZCR) by dividing a count of transitions from a negative sample value to a positive sample value by a count of sample values in the frame; and determining the ZCR is below a ZCR threshold value.

3. The head-mounted wearable device of claim 1, the electronics performing one or more of determining the second BC signal data or determining the second AC signal data by:

determining, for a frame of the second BC signal data or the second AC signal data comprising a plurality of sample values representative of a signal, a value indicative of energy of the signal by:

calculating a square for each of the sample values, calculating a sum of the squares, and dividing the sum by a number of samples in the frame; and determining the value indicative of energy is greater than an energy threshold value.

4. A wearable system comprising:

a bone conduction (BC) microphone responsive to vibrations to produce bone conduction (BC) signal data representative of output from the BC microphone;

an air conduction (AC) microphone responsive to sounds transferred via air to produce air conduction (AC) signal data representative of output from the AC microphone; and one or more processors executing instructions to:

determine, at a first time, first BC signal data indicative of an absence of speech;

determine first AC signal data that is associated with the first time;

determine noise data based on the first AC signal data associated with the first time;

determine, at a second time, second BC signal data indicative of speech;

determine second AC signal data that is associated with the second time;

determine a correlation threshold value based on the noise data, the correlation threshold value representing a minimum value of correspondence between the second AC signal data and the second BC signal data that indicates the second AC signal data and the second BC signal data are representative of a same speech;

determine that a cross-correlation between the second AC signal data and the second BC signal data exceeds the correlation threshold value;

determine, responsive to the cross-correlation exceeding the correlation threshold value, the second AC signal data and the second BC signal data are representative of the same speech; and trigger an action based on the second AC signal data and the second BC signal data being representative of the same speech, the action including eliminating noise data from the second AC signal data.

5. The wearable system of claim 4, further comprising instructions to:

determine a zero crossing rate (ZCR) of one or more of the second BC signal data or the second AC signal data; and determine that the ZCR of the one or more of the second BC signal data or the second AC signal data is less than a threshold value.

6. The wearable system of claim 5, wherein the instructions to determine the ZCR further comprise instructions to:

determine, for a frame of the second BC signal data comprising a plurality of sample values representative of a signal, the ZCR by dividing a count of transitions from a negative sample value to a positive sample value by a count of sample values in the frame.

7. The wearable system of claim 4, further comprising instructions to:

determine energy of one or more of the second BC signal data or the second AC signal data; and determine the energy of the one or more of the second BC signal data or the second AC signal data is greater than a threshold minimum value and less than a threshold maximum value.

8. The wearable system of claim 7, further comprising instructions to:

determine the noise data is indicative of a maximum detected noise energy of the second AC signal data;

access a look up table that designates a particular threshold maximum value with a particular value of the noise data; and determine the threshold maximum value by using the particular value of the noise data to find the particular threshold maximum value.

9. The wearable system of claim 7, wherein the instructions to determine the energy of the one or more of the second BC signal data or the second AC signal data further comprise instructions to:

determine, for a frame of the second BC signal data comprising a plurality of sample values representative of a signal, a value indicative of energy of the signal by:

calculating a square for each of the sample values, calculating a sum of the squares, and dividing the sum by a number of samples in the frame; and determine the value indicative of energy is greater than an energy threshold value.

10. The wearable system of claim 4, the one or more processors executing instructions to:

determine a similarity value indicative of similarity between at least a portion of the second BC signal data and at least a portion of the second AC signal data;

determine the similarity value exceeds a similarity threshold value; and wherein the similarity value exceeding the similarity threshold value is indicative of the second AC signal data and the second BC signal data being the speech.

11. The wearable system of claim 10, wherein the instructions to determine the similarity value further comprise instructions to:

determine a similarity value indicative of a similarity between the second BC signal data and the second AC signal data that occur within a common time window;

determine third data indicative of the similarity value exceeding a similarity threshold value; and wherein the third data is indicative of the second AC signal data and the second BC signal data being the speech.

12. The wearable system of claim 4, wherein the second BC signal data is determined by:

determining a zero crossing rate (ZCR) of the second BC signal data;

determining the ZCR of the second BC signal data is less than a threshold value;

determining energy of a signal represented by the second BC signal data;

determining a threshold maximum value based on the noise data; and determining the energy of the second BC signal data is greater than a threshold minimum value and less than the threshold maximum value; and wherein the second AC signal data is determined by:

determining a ZCR of the second AC signal data;

determining the ZCR of the second AC signal data is less than a threshold value;

determining energy of a signal represented by the second AC signal data; and determining the energy of the second AC signal data is greater than a threshold minimum value.

13. The wearable system of claim 10, wherein the BC microphone and the AC microphone are mounted to a frame at a predetermined distance to one another; and the instructions to determine the similarity value further comprise instructions to:

determine the similarity between a portion of the second BC signal data and a portion of the second AC signal data that occur within a common time window of one another, wherein a duration of the common time window is based on a time difference between propagation of signals with respect to the BC microphone and the AC microphone.

14. The wearable system of claim 4, the one or more processors executing instructions to:

determine that the noise data is indicative of a maximum noise energy of the second BC signal data;

wherein the instructions to determine the second BC signal data further comprise instructions to:

determine a zero crossing rate (ZCR) of the second BC signal data;

determine the ZCR of the second BC signal data is less than a threshold value;

determine an energy value of the second BC signal data; and determine that the energy value of the second BC signal data is greater than a threshold minimum value and less than a threshold maximum value, wherein the threshold maximum value is based at least in part on a maximum energy; and the instructions to determine the second AC signal data further comprise instructions to:

determine a zero crossing rate (ZCR) of the second AC signal data;

determine the ZCR of the second AC signal data is less than a threshold value;

determine an energy value of the second AC signal data; and determine that the energy value of the second AC signal data is greater than a threshold minimum value.

15. The system of claim 4, wherein the correlation threshold value is inversely proportional to an average detected noise energy indicated by the noise data.

16. The system of claim 4, further comprising instructions to:

determine a change to ambient noise represented by the noise data;

determine second noise data in response to the change in ambient noise; and determine a second correlation threshold value based on the second noise data.

17. A method comprising:

accessing bone conduction (BC) signal data representative of output from a BC microphone affixed to a device;

determining first BC signal data indicating an absence of speech from the BC microphone at a first time;

determining first air conduction (AC) signal data from an AC microphone that is associated with the first time;

determining noise data based on the first AC signal data associated with the first time obtained while the first BC signal data indicates the absence of speech from the BC microphone at the first time;

determining second BC signal data indicative of a presence of speech from the BC microphone at a second time;

determining second AC signal data from the AC microphone that is associated with the second time;

determining a correlation threshold value based on the noise data, the correlation threshold value representing a minimum value of correspondence between the second AC signal data and the second BC signal data that indicates the second AC signal data and the second BC signal data are representative of a same speech;

determining that a cross-correlation between the second BC signal data and the second AC signal data exceeds the correlation threshold value;

determining, based on the cross-correlation exceeding the correlation threshold value, the second AC signal data and the second BC signal data are representative of the same speech; and triggering an action based on the second AC signal data and the second BC signal data representing the same speech, the action including eliminating noise data from the second AC signal data.

18. The method of claim 17, further comprising:

determining a similarity value indicative of a similarity between the second BC signal data and the second AC signal data that occur within a common time window;

determining third data indicative of the similarity value exceeding a similarity threshold value; and wherein the third data is indicative of the second AC signal data and the second BC signal data being the speech.

19. The method of claim 18, the determining the similarity between the second BC signal data and the second AC signal data comprising:

determining a cross-correlation value indicative of a correlation between the second BC signal data and the second AC signal data that occurs within a specified time window.

20. The method of claim 17, further comprising:

determining noise data based on the second AC signal data, wherein the noise data is indicative of a maximum energy of the second AC signal data;

wherein the determining the second BC signal data comprises:

determining a zero crossing rate (ZCR) of the second BC signal data;

determining the ZCR of the second BC signal data is less than a threshold value;

determining energy of a signal represented by the second BC signal data;

determining a threshold maximum value based on the noise data; and determining the energy of the second BC signal data is greater than a threshold minimum value and less than the threshold maximum value; and wherein the determining the second AC signal data comprises:

determining a ZCR of the second AC signal data;

determining the ZCR of the second AC signal data is less than a threshold value;

determining energy of a signal represented by the second AC signal data; and determining the energy of the second AC signal data is greater than a threshold minimum value.

21. The method of claim 17, wherein the correlation threshold value is inversely proportional to an average detected noise energy indicated by the noise data.

* * * * *